US008117808B2

(12) United States Patent
Strasser

(10) Patent No.: US 8,117,808 B2
(45) Date of Patent: Feb. 21, 2012

(54) APPARATUS AND METHOD FOR TRANSVERSE SEALING OF A PACKAGING TUBE

(75) Inventor: Thomas Strasser, Benken (CH)

(73) Assignee: Robert Bosch GmbH, Stuttgart (DE)

( * ) Notice: Subject to any disclaimer, the term of this patent is extended or adjusted under 35 U.S.C. 154(b) by 1041 days.

(21) Appl. No.: 11/629,189

(22) PCT Filed: Apr. 12, 2005

(86) PCT No.: PCT/DE2005/000653
§ 371 (c)(1),
(2), (4) Date: Dec. 11, 2006

(87) PCT Pub. No.: WO2005/123514
PCT Pub. Date: Dec. 29, 2005

(65) Prior Publication Data

US 2008/0016826 A1 Jan. 24, 2008

(30) Foreign Application Priority Data

Jun. 16, 2004 (CH) ..... 01019/04

(51) Int. Cl.
*B65B 51/30* (2006.01)

(52) U.S. Cl. ..... 53/479; 53/371.5; 53/374.4; 53/550; 53/552

(58) Field of Classification Search ..... 53/479, 53/450, 547, 550, 374.4, 64, 389.4, 389.5, 53/371.4, 371.5, 372.4
See application file for complete search history.

(56) References Cited

U.S. PATENT DOCUMENTS

| | | | | |
|---|---|---|---|---|
| 2,546,721 | A * | 3/1951 | Campbell | 53/433 |
| 3,090,174 | A * | 5/1963 | Kraft | 53/433 |
| 3,657,856 | A | 4/1972 | Planner | |
| 3,959,952 | A * | 6/1976 | Deutschlander | 53/370.6 |
| 3,982,381 | A | 9/1976 | Bolli | |
| 4,102,111 | A * | 7/1978 | Nack et al. | 53/552 |
| 4,106,265 | A * | 8/1978 | Aterianus | 53/550 |
| 4,254,601 | A * | 3/1981 | Prager et al. | 53/133.8 |
| 4,549,386 | A * | 10/1985 | Wilson | 53/51 |
| 4,726,168 | A * | 2/1988 | Seko | 53/450 |
| 5,052,166 | A * | 10/1991 | Ziegler et al. | 53/433 |
| 5,537,802 | A * | 7/1996 | Orndorff | 53/450 |
| 2001/0010144 | A1 | 8/2001 | Strasser | |

FOREIGN PATENT DOCUMENTS

EP 1 281 620 A1 2/2003

* cited by examiner

*Primary Examiner* — Thanh Truong
(74) *Attorney, Agent, or Firm* — Ronald E. Greigg

(57) ABSTRACT

An apparatus for transverse sealing of a packaging tube, filled with products, in order to form bag packages, has a delivery conveyor for delivering the packaging tube, a removal conveyor for carrying the bag packages away and a transverse sealing unit engaging an interstice between these two conveyors. Means is provided for supporting the bag packages at least in part at the transition through this interstice. This means for supporting the bag packages is a supporting base, which reaches beneath the bag packages from two diametrically opposed sides and both supports the bag packages and transports them onward.

15 Claims, 5 Drawing Sheets

APPARATUS AND METHOD FOR TRANSVERSE SEALING OF A PACKAGING TUBE

CROSS-REFERENCE TO RELATED APPLICATIONS

This application is a 35 USC 371 application of PCT/DE 2005/000653 filed on Apr. 12, 2005.

BACKGROUND OF THE INVENTION

The invention relates to an apparatus for and a method of transverse sealing of a packaging tube, filled with products, and more particularly to a horizontal machine that makes bag packages.

DESCRIPTION OF THE PRIOR ART

In horizontal machines that make bag packages, a bandlike strip of packaging material, particularly of film, is drawn from a roll; a product, typically one or more bulk items, is placed on the length of packaging material; the film is folded and longitudinally sealed. Next, the packaging tube is divided into individual product packages or bag packages, because transverse sealing seams are welded. Typically, the individual bag packages are separated from one another by means of a knife during or shortly after the transverse sealing and transported in succession via a removal conveyor onward for further processing or packaging. U.S. Pat. Nos. 5,685,131 and 4,726,168 for instance disclose horizontal machines for making bag packages that have a transverse sealing unit. U.S. Pat. No. 4,949,846 shows the simultaneous transverse sealing and separation of the bags.

Since the transverse sealing unit must contact the packaging tube from above as well as from below, it reaches with its sealing jaws into an interstice between the delivery conveyor and the removal conveyor. In this region, the packaging tube or bag package is not guided. In the prior art, it is therefore proposed that the sealing roller of the lower sealing jaw be provided with a support ring, which supports the bag package over at least a portion of it. One such support ring is shown in Swiss Patent Disclosure CH-A 554'260 for instance.

However, since the support ring is also roller-shaped and its axis of rotation extends transversely to the conveying direction in a plane parallel to the conveying plane, an interstice or hole still remains between this support ring and the upstream end of the removal conveyor belt. Since the packaging material surrounding the product has too little rigidity, especially if it is a thin film, short products especially have a tendency to tilt into this hole. This is especially true for products that are both short in length and tall in height.

It is also proposed in U.S. Pat. No. 4,862,673 that the interstice between two pairs of sealing jaws be spanned by an endlessly revolving chain or a conveyor belt. To give the sealing jaws enough space for their rotary motion, however, once again there is a relatively large open gap between the conveyor chain and the sealing roller or the next conveyor.

In U.S. Pat. No. 4,102,111 as well, a horizontal machine for making bag packages and having a transverse sealing unit is disclosed. In the region of the transverse sealing jaws, pivotable edge feeders are provided, which fold the bags inward laterally in the transverse sealing process.

SUMMARY OF THE INVENTION

It is therefore an object of the invention to create an apparatus and a method that prevent the bag packages in this interstice from tilting, while not impairing the conveying speed.

The apparatus according to the invention for transverse sealing of a packaging tube, filled with products, in order to form bag packages, has a delivery conveyor for delivering the packaging tube, and a removal conveyor for carrying the bag packages away as well as a transverse sealing unit engaging an interstice between these two conveyors. Moreover, a means for supporting the bag packages which supports the bag packages at least in part at the transition through this interstice. According to the invention, this means for supporting the bag packages is a supporting base, which reaches beneath the bag packages from two diametrically opposed sides.

The supporting base is embodied movably, so that as needed it can be put out of range of those parts of the transverse sealing unit that from time to time reach into the interstice in order to perform the transverse sealing. It also has a speed component in the conveying direction, so that it takes on not only a supporting function but also a transporting function.

In the case of sealing rollers with transverse sealing jaws, the supporting base is formed by at least two bearing rings, which are rotatable about axes that are perpendicular to the conveying plane and protrude with their periphery into the interstice and thus support the bag packages. They also have recesses into which the transverse sealing jaws can optionally reach.

A lateral guide is preferably present on the supporting base, on both sides of the conveying path, for laterally guiding the bag packages as they pass through the interstice.

The apparatus and the method according to the invention have the advantage that the products packed in bag packages are transported and guided safely even within range of the transverse sealing station or the region immediately adjoining it. This is especially true for products of short length and tall height, especially bulk items stacked one above the other in a bag package, such as cookies or crackers. The packaging material or film can be made from very thin, flexible material, since adequate rigidity of the packaging material is no longer necessary for secure guidance.

A further advantage is that the supporting base can be replaced in a simple way so as to be adapted to the particular shapes and sizes of the products and bag packages. Another advantage is that existing horizontal machines for making bag packages can be retrofitted with supporting bases of this kind.

BRIEF DESCRIPTION OF THE DRAWINGS

The subject of the invention will be described below in terms of a preferred exemplary embodiment, in conjunction with the accompanying drawings, in which.

DESCRIPTION OF THE PREFERRED EMBODIMENTS

Figure 1A:
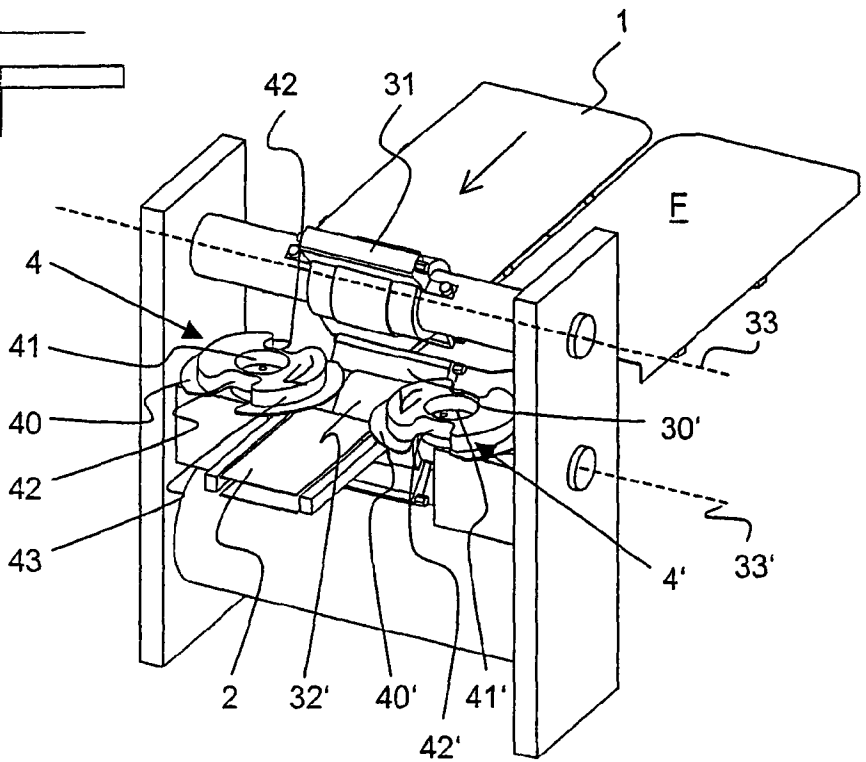
FIG. 1*a* is a schematic perspective view of the apparatus of the invention in a first conveying position.
Figure 1B:
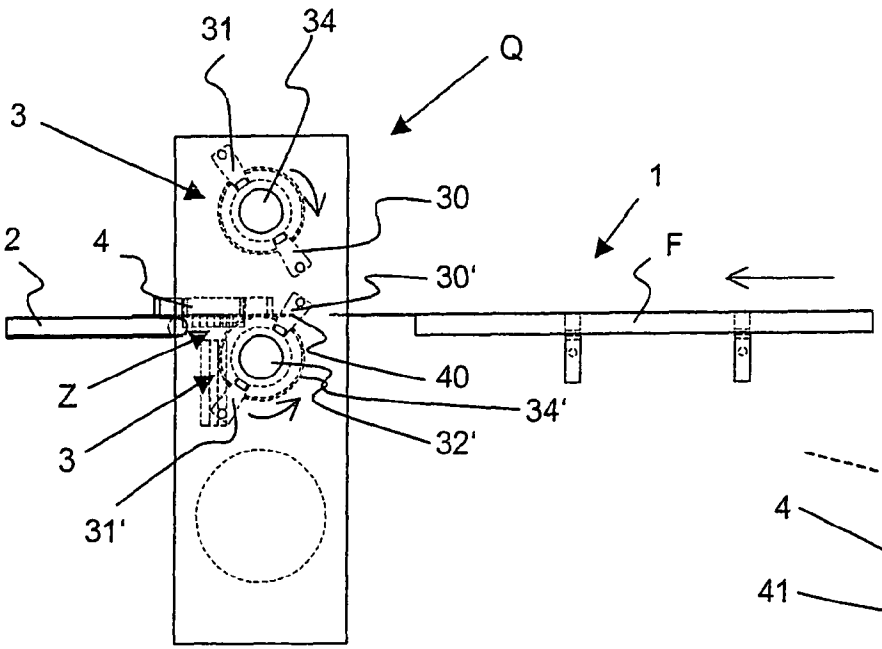
FIG. 1*b*, a schematic side view of the apparatus of the invention in the position of FIG. 1*a;*

In FIGS. 1*a* and 1*b*, an apparatus of the invention is shown as having an infeed or delivery conveyor 1 in the form of two slide plates extending parallel to one another. However, it is also possible to use conveyor belts or other transporting means. On this delivery conveyor 1, a packaging tube, not shown, which has already been filled with products, folded, and longitudinally sealed beforehand, is conveyed with the products located in it to a transverse sealing unit Q. The conveying direction is represented by an arrow. A removal conveyor 2 is located adjacent to the transverse sealing unit Q. The removal conveyor is likewise a one-piece or multiple-piece, endlessly revolving conveyor belt. Between the delivery conveyor 1 and the removal conveyor 2, there is an interstice Z, into which the transverse sealing unit Q reaches.

The conveyed and packaged products can be of different kinds; for example, each product may comprise a single bulk material. In other fields of use, each product comprises multiple bulk items, for instance stacked one above the other or lined up upright one after the other. The products may also already include a first package. In particular, the products may be foods such as cookies or crackers. The packaging material may also comprise the most various materials. Preferably, it is a thin, flexible packaging film.

The known units can be used as the transverse sealing unit Q. In the example shown here, it has at least one first upper sealing roller 3 and at least one lower sealing roller 3'. These two sealing rollers 3, 3' are supported rotatably on axes of rotation 33, 33' extending parallel to one another. The axes of rotation 33, 33' extend in an upper and a lower plane, respectively, parallel to the conveying plane F, perpendicular to the conveying direction.

On each sealing roller 3, 3' there is at least one and in this case two sealing jaws 30, 30', 31, 31', which protrude past the roller body 34, 34' in the radial direction. The sealing jaws 30, 30', 31, 31' are heatable. The sealing rollers 3, 3' preferably rotate counter to one another; the sealing jaws 30, 30', 31, 31' move in the conveying direction in the region between the two conveyors 1, 2 and in this region each contact the packaging material from one side and weld it to form a transverse seam N (FIG. 5). To enable the welding to be performed optimally, the sealing jaws thus move along with the packaging material for a certain period of time.

The sealing jaws 30, 30', 31, 31' and sealing rollers 3, 3' may also be provided with at least one cutting knife or support means, in order to cut apart the individual transversely sealed bag packages or provide them with a perforation for the sake of later separation.

According to the invention, there is now a means for supporting the bag packages, located in the region of the transverse sealing unit Q; it supports and guides the individual bag packages in the transition through the interstice Z, so that they cannot tip into the interstice.

This means is a supporting base, which reaches under the bag packages from two diametrically opposed sides and supports at least their peripheral region. The supporting base can be embodied in manifold ways. In the example shown here, the supporting base is formed by at least two bearing rings 40, 40', which are embodied as protruding flanges, each from a respective gap compensation disk 4, 4'.

The bearing rings 40, 40' are located at least approximately at the same height above the base as the highest support point in the interstice, or at the ends, adjacent thereto of the conveyors 1, 2. If a support ring 32' of a known type is connected in the interstice to the lower sealing roller 3', then the upper bearing face of the bearing rings 40, 40' is preferably aligned with the upper apex of this support ring 32'.

Each gap compensation disk 4, 4' has a disk body 43, 43', which protrudes radially past the bearing ring 40, 40'. Each two of the at least two gap compensation disks 4, 4' are located one adjacent to each of the two diametrically opposed sides of the conveying plane F, and the spacing of the two disk bodies 43, 43', measured between their outer jacket points, corresponds approximately to the width of the bag package B, or of the product packed in it. As a result, on passing through the interstice Z, the product is not only supported from below but also guided laterally.

The gap compensation disks 4, 4' are rotatably supported; they are each rotatable about an axis of rotation 44, 44' extending perpendicular to the conveying plane. The individual axes of rotation 44, 44' extend parallel to one another but perpendicular to the axes of rotation 33, 33' of the sealing rollers 3, 3'.

Each gap compensation disk 4, 4' has a central opening 41, 41'. Located in this central opening 41, 41' are fastening means, in particular screws, by means of which the disks 4, 4' are fastened in the transverse sealing unit Q or in a suitable frame of the apparatus.

If the type of product or the shape and size of the bag package is to be changed, the gap compensation disks 4, 4' can easily be taken out and replaced, for instance by disks having a greater thickness and/or a greater diameter. Preferably, however, all the gap compensation disks 4, 4' have the same thickness, measured from below, in the region of the central opening 41, 41'. As a result, fastening screws of the same length can always be used.

The bearing rings 40, 40', or in this case the complete gap compensation disks 4, 4', have at least one radially extending recess 42, 42'. Typically, per disk 4, 4', there are the same number of recesses 42, 42' as there are sealing jaws 31, 31' or other parts protruding past the rollers 3, 3' into the interstice Z at any time. The radial recesses 42, 42' are large and deep enough that these jaws 31, 31' or parts can plunge into the disks 4, 4' without colliding and thus can reach into the recesses 42, 42' without touching them.

In FIGS. 1*a* and 1*b*, a first conveying position is shown. The two first sealing jaws 30, 30' are raised and lowered slightly above and below the conveying plane, to allow the next product to pass through. The bearing rings 40, 40' are located in the interstice Z and form a supporting base on both sides, which extends over the entire length of the interstice, measured from the sealing rollers 3, 3' to the adjacent end of the removal conveyor 2. A product which would thus be located in the present position in the interstice would be supported not only by the support ring 32' but also by the supporting base. The support ring 32' itself is not absolutely necessary and can in principle also be omitted.

Figure 2A:
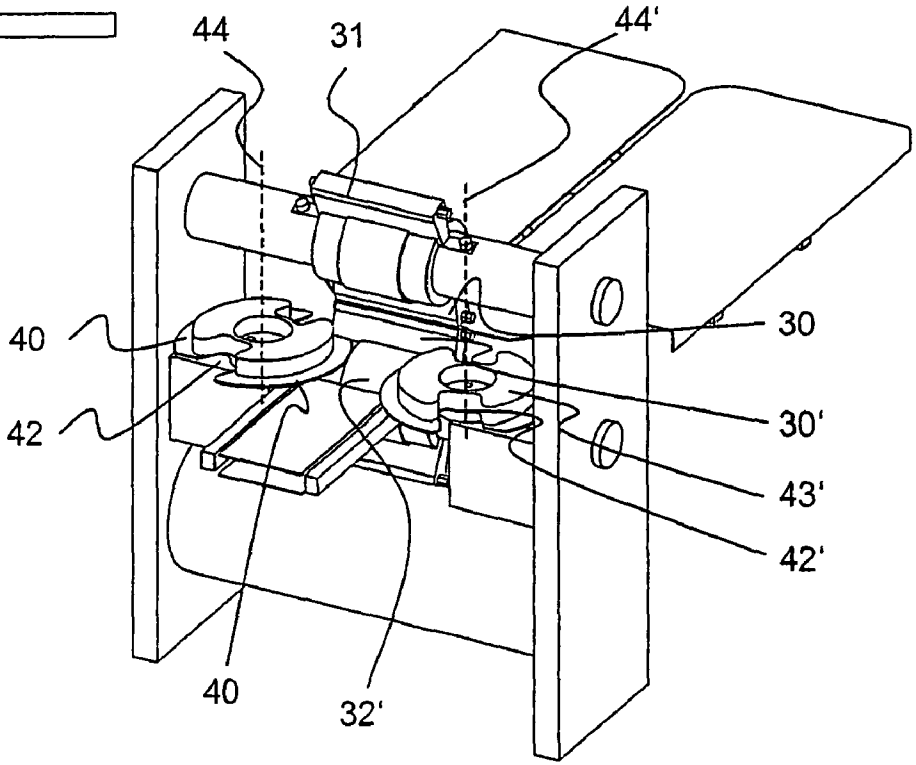
FIG. 2*a*, the apparatus of FIG. 1*a* in a second conveying position.
Figure 2B:
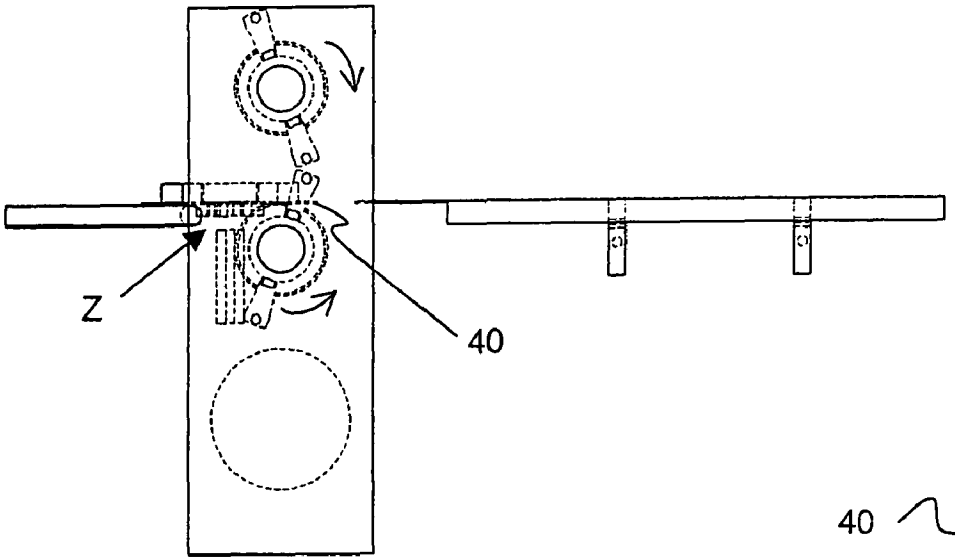
FIG. 2*b*, a side view of the apparatus in the position of FIG. 2*a;*

In the position shown in FIGS. 2*a* and 2*b*, the sealing jaws 30, 30' have been rotated in the conveying direction. Their direction of rotation is represented by curved arrows. They have approached one another and can now for the first time contact the packaging material with their front edges and welded. As FIG. 2*a* shows, the compensation disks 4, 4' have also rotated by now, and in the process the rear recesses 42, 42' have approached the interstice.

Figure 3A:
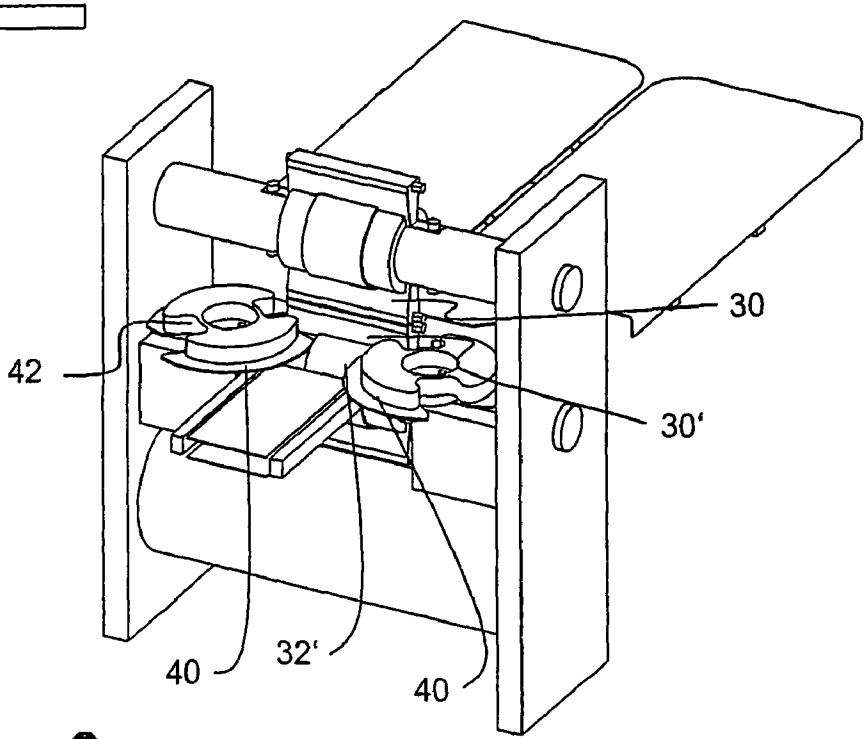
FIG. 3*a*, the apparatus of FIG. 1*a* in a third conveying position.
Figure 3B:
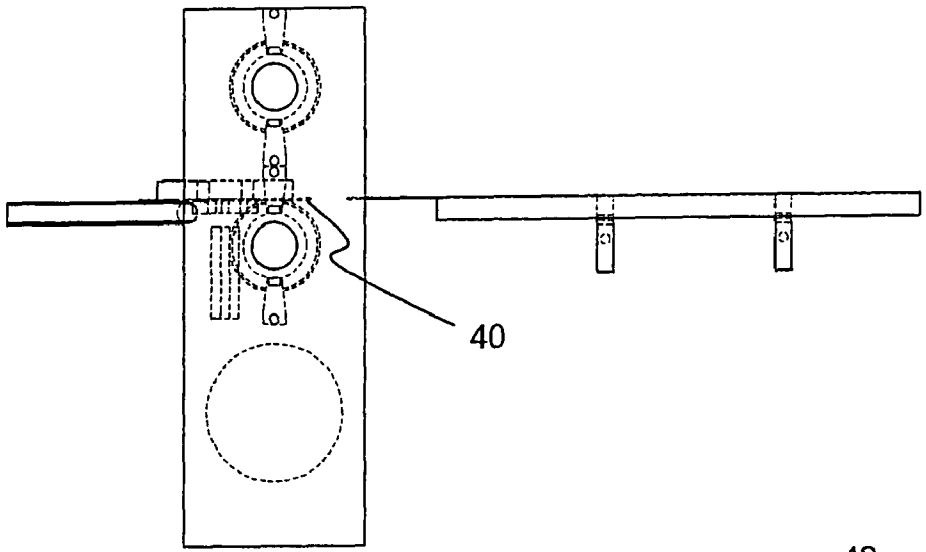
FIG. 3*b*, a side view of the apparatus in the position of FIG. 3*a;*

In FIGS. 3*a* and 3*b*, the sealing jaws 31, 31' now contact one another completely and are located centrally within the interstice Z. At this time they reach partway into the recesses 42, 42'.

Figure 4A:
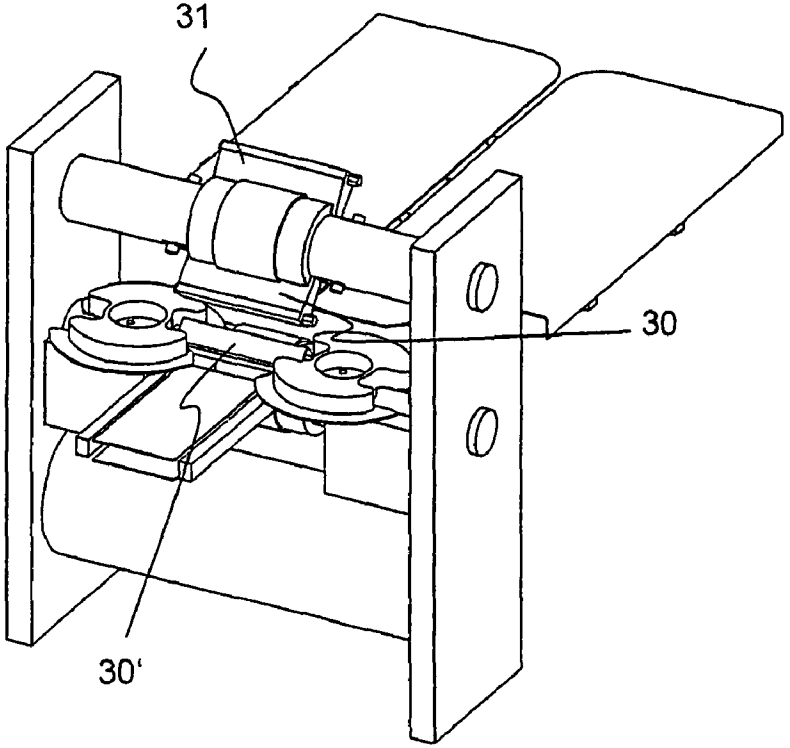
FIG. 4*a*, the apparatus of FIG. 1*a* in a fourth conveying position.
Figure 4B:
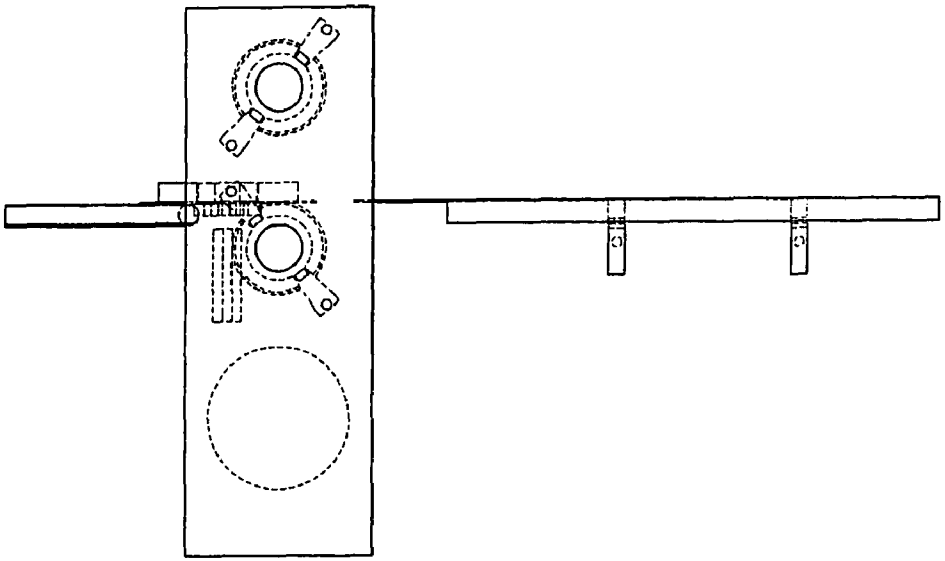
FIG. 4*b*, a side view of the apparatus in the position of FIG. 4*a;*

In the position in FIGS. 4*a* and 4*b*, the sealing jaws 31, 31' and the compensation disks 4, 4' have rotated onward synchronously, so that the sealing jaws 31, 31' reach into the recesses 42, 42' without colliding.

Figure 5A:
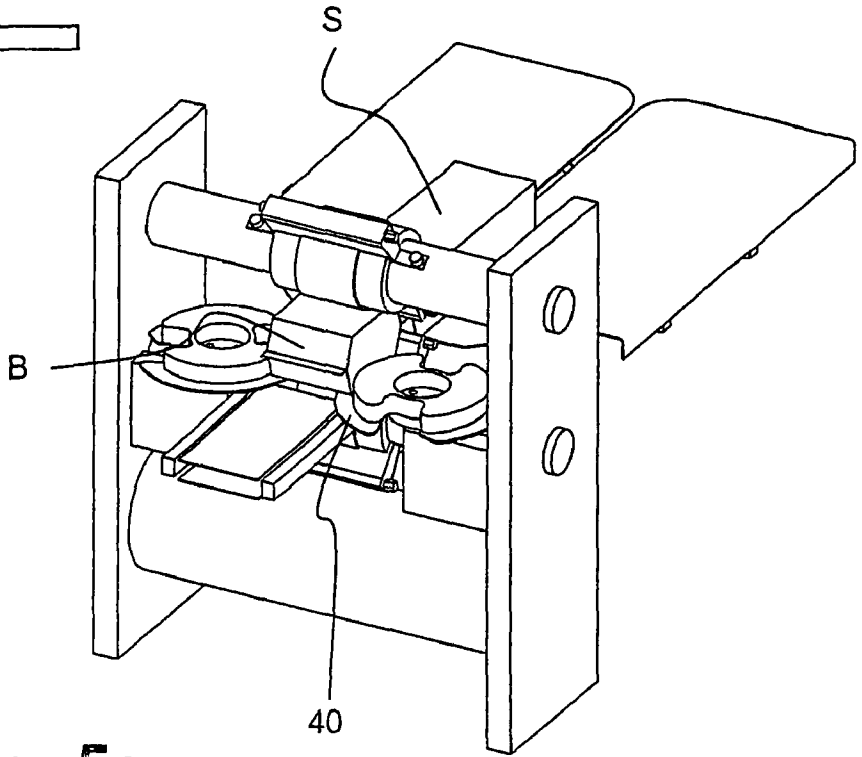
FIG. 5*a*, the apparatus of FIG. 1*a* showing a bag package.
Figure 5B:
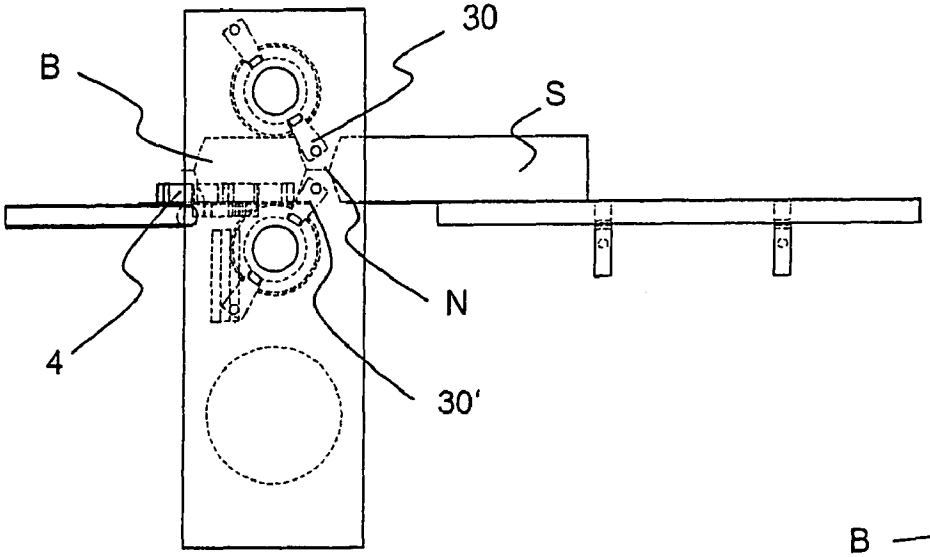
FIG. 5*b*, a side view of the apparatus of FIG. 5*a*.

In FIGS. 5*a* and 5*b*, a packaging tube S and a bag package B, with a product packed in it, have also been shown for the sake of clarity.

The gap compensation disks 4, 4' and the sealing rollers 3, 3' are thus advantageously moved synchronously with one another. The speed component of the gap compensation disks 4, 4' in the conveying direction is at least approximately and preferably precisely equivalent to the conveying speed of the packaging tube S in the region of the transverse sealing unit. The gap compensation disks 4, 4' and the sealing rollers 3, 3' thus execute a so-called "limping motion".

The bearing rings preferably execute a rotary motion. However, it is also possible to move the supporting base in some other way. For instance, it can be pivoted into and back out of the region of the interstice.

The synchronization of the motion of the bearing rings and the sealing jaws can be done electronically via a controller. In a preferred embodiment, however, the two compensation disks 4, 4' are connected via a gear drive to one of the two sealing rollers 3, 3', and in particular to the lower one. A preferred construction of the gear is as follows: A gear wheel located on the lower sealing roller 3' meshes with a driving gear wheel, which via a bevel gear wheel drives the respective compensation disk 4, 4' about their vertical axis of rotation. Care must be taken to assure that the two compensation disks 4, 4' move contrary to one another and have a forward component in the conveying direction. A belt drive can be placed between the bevel gear wheel and the axis of rotation.

The apparatus according to the invention permits transporting the bag packages in guided fashion through the interstice between the two conveyors that is created for the transverse sealing unit.

The foregoing relates to a preferred exemplary embodiment of the invention, it being understood that other variants and embodiments thereof are possible within the spirit and scope of the invention, the latter being defined by the appended claims.

The invention claimed is:

1. An apparatus for transverse sealing of a packaging tube, filled with products, in order to form bag packages, the apparatus comprising a delivery conveyor for delivering the packaging tube in a conveying direction along a conveying path, a removal conveyor for carrying the bag packages away, a transverse sealing unit engaging an interstice between these two conveyors, and a supporting base which reaches beneath the bag packages from two diametrically opposed sides for supporting the bag packages at least in part at the transition through this interstice, wherein the supporting base comprises at least two support disks, and wherein each support disk has one axis of rotation which extends perpendicular to the conveying direction of the bag packages, the axis of rotation of one of the support disks being disposed outside of a side edge of the conveying path and the axis of rotation of another of the support disks being disposed outside an opposite side edge of the conveying path.

2. The apparatus as defined by claim 1, wherein the delivery conveyor and the removal conveyor each have one conveying plane, which extends at least approximately horizontally at least in the region of the transverse sealing unit.

3. The apparatus as defined by claim 2, wherein each support disk has recesses for collision-freely receiving parts of the transverse sealing unit.

4. The apparatus as defined by claim 3, wherein each support disk is rotatable synchronously with a sealing motion of the transverse sealing unit and has a speed component in the conveying direction of the bag packages which corresponds at least approximately to a conveying speed of the packaging tube in the region of the transverse sealing unit.

5. The apparatus as defined by claim 1, wherein each support disk has recesses for collision-freely receiving parts of the transverse sealing unit.

6. The apparatus as defined by claim 5, wherein each support disk is rotatable synchronously with a sealing motion of the transverse sealing unit and has a speed component in the conveying direction of the bag packages which corresponds at least approximately to a conveying speed of the packaging tube in the region of the transverse sealing unit.

7. The apparatus as defined by claim 1, wherein the transverse sealing unit comprises one upper and one lower rotatable sealing roller, each with at least one sealing jaw disposed on it.

8. The apparatus as defined by claim 1, further comprising a support ring in the interstice, which support ring rotates about the same axis as the lower transverse sealing roller.

9. The apparatus as defined by claim 8, wherein the supporting base is disposed at the same level as a bearing face of the two conveyors, or as the highest point of the support ring in the region of the interstice.

10. The apparatus as defined by claim 1, wherein the supporting base comprises lateral guides disposed on both sides of the conveying path, the spacing of the lateral guides being approximately equivalent to the width of the products.

11. The apparatus as defined by claim 1, wherein the transverse sealing unit comprises one upper and one lower rotatable sealing roller, each with at least one sealing jaw disposed on it, wherein each of the support disks includes a protruding flange, and wherein each axis of rotation of a support disk extends perpendicular to axes of rotation of the sealing rollers.

12. The apparatus as defined by claim 11, wherein the spacings of two diametrically opposed support disks, disposed on two different sides of the apparatus, corresponds approximately to a width of the product, so that the bag package moving past the two disk bodies is guided by them by means of lateral contact.

13. In a method for transverse sealing of a packaging tube filled with products in order to form bag packages, the method comprising the steps of delivering the packaging tube in a conveying direction along a conveying path via a delivery conveyor to a transverse sealing unit, transversely sealing the tube by the transverse sealing unit to form bag packages, removing the bag packages from the transverse sealing unit via a removal conveyor, providing an interstice between the two conveyors, causing the transverse sealing unit in the transverse sealing operation to reach into the interstice to seal the package between these two conveyors, and guiding and supporting the bag packages on passing through this interstice via a supporting base, which during the passage of the bag packages reaches at least intermittently into the interstice under the bag packages from two diametrically opposed sides, wherein the supporting base comprises at least two support disks, and wherein the support disks each have one axis of rotation which extends perpendicular to the conveying direction of the bag packages, the axis of rotation of one of the support disks being disposed outside of a side edge of the conveying path and the axis of rotation of another of the support disks being disposed outside an opposite side edge of the conveying path.

14. The method as defined by claim 13, further comprising moving the supporting base out of range of the transverse sealing unit to avoid a collision with the transverse sealing unit during the sealing step.

15. The method as defined by claim 13, wherein the supporting base transports the bag packages in the conveying direction.

* * * * *